United States Patent [19]

Choate

[11] 4,236,500

[45] Dec. 2, 1980

[54] LOG-BURNING STOVE

[76] Inventor: James R. Choate, P.O. Box 2409, Rochester, N.H. 03867

[21] Appl. No.: 896,203

[22] Filed: Apr. 13, 1978

Related U.S. Application Data

[63] Continuation of Ser. No. 789,517, Apr. 21, 1977, Pat. No. 4,131,104.

[51] Int. Cl.[3] ..... F23M 5/00

[52] U.S. Cl. ..... 126/145; 126/144

[58] Field of Search ..... 126/77, 8, 12, 13, 87, 126/144–148, 87, 128, 151; 110/323

[56] References Cited

U.S. PATENT DOCUMENTS

| | | | |
|---|---|---|---|
| 916,658 | 3/1909 | Billow | 126/146 X |
| 2,345,519 | 3/1944 | Wingert | 126/77 |
| 4,095,586 | 6/1978 | Selva | 126/8 |

*Primary Examiner*—Samuel Scott

*Assistant Examiner*—Wesley S. Ratliff, Jr.

[57] ABSTRACT

A log-burning stove which contains a full refractory firebox, the stove designed to permit the easy insertion of large, economical, wood logs, particularly green logs, which stove comprises a shell defining a combustion chamber, the combustion chamber fully lined with refractory material, and having an entrance and a full-length loading door adapted to permit the easy introduction of logs into the combustion chamber, the door adapted to move between a closed, upright, sealed position and an open supporting position extending generally laterally from the lower portion of the entrance opening, the door containing roller means on the internal surface thereof which provides for the lateral movement of a large log thereon which permits the positioning of the log adjacent the center of the entrance, whereby, after said positioning of the log adjacent the opening, the log may be moved inwardly through the entrance and into the combustion chamber.

18 Claims, 5 Drawing Figures

LOG-BURNING STOVE

This is a continuation of application Ser. No. 789,517, filed Apr. 21, 1977 now U.S. Pat. No. 4,131,104.

BACKGROUND OF THE INVENTION

Wood stoves, particularly log-burning stoves, of antique and current design, are often quite unsatisfactory for the loading and burning of heavy logs, or for the satisfactory combustion of green logs therein. Such stoves often accomodate only logs of small or less than economical size, and, even if large enough to accept heavy full-length logs, such stoves do not provide provisions for the easy loading and inserting of the logs into the combustion chamber. Furthermore, such prior-art stoves are not designed to burn green logs, particularly large green logs. In addition, often stoves, antique or modern, tend to dissipiate a large amount of heat up the chimney, and do not provide an effective heat-sink design or a large enough surface-radiation area coupled with combustion efficiency. Therefore, there is a need for a scientifically designed log-burning stove which is easy to load, burns green logs and has an effective heat-sink design, and which will overcome other problems associated with prior-art stoves.

SUMMARY OF THE INVENTION

My invention is directed to a log-burning stove, a method of manufacturing the stove and of using and operating said stove. In particular, my invention is directed to a log-burning stove which provides for the easy loading or positioning of large, economical, heavy logs in a rapid and efficient manner. Furthermore, my invention is directed to a log-burning stove characterized by a full refractory design which permits the efficient combustion of large green logs. More particularly, my invention is directed to a log-burning stove which has a unique draft-control means which extends across a substantial length of the combustion chamber of the stove.

My stove permits the easy loading and inserting into the combustion chamber of large, heavy, economical logs, so that such logs may be inserted into the combustion chamber with a minimum of effort, so that a child or a woman can load the stove with such logs. For example, a child or woman may walk a full-size log along its ends and then tip the log onto the loading door of my stove, easily center the log adjacent the inlet or entrance of the combustion chamber and then move the log into the combustion chamber in particular by forcing the log into the combustion chamber employing the leverage of a long door handle to move the centered log into the combustion chamber by the upward movement of the loading door. Thus, my stove is designed to employ particularly large, economical, heavy logs which represent the most economical wood for combustion. For example, my stove is designed to permit the loading and combusting of logs of a size of over 30 inches in length, and logs having a diameter, for example, of greater than 9 inches; for example, 9 to 12 inches or higher. The large, economical, generally rectangular design of my stoves permits the stoves to hold two or more large logs or smaller combinations.

One feature of my stove is that it has a full refractory design, with the top, ends and back of the stove having refractory material about the combustion chamber or firebox, such as refractory plate material, which enhances the heat efficiency of my stove. The full refractory firebox of my stove maintains heat within the combustion chamber, and, therefore, the high temperature maintained permits the preheating and later burning of green logs, and also provides for the rapid burnoff of pyroligneous acid (creosote) with a minimum of flue or chimney clogging. By maintaining a high fire temperature in the refractory combustion chamber or firebox, logs inserted therein may be burned with very little fire required to maintain the high temperature level within the refractory firebox. In my stove, a fire is started at the rear of the firebox or combustion chamber employing a dry or soft-wood log that is used to start initially the combustion, and, thereafter, a green log, such as a second log, is placed in the front portion of the firebox adjacent the door, so that, while the rear log burns to coals, the front log or green log cooks or cures and moisture is driven off. Thereafter, when a new green log is inserted, employing my unique loading-door system, the front log, formerly a green log, now is reasonably cured and dried and may be rolled easily toward and to the rear portion of the firebox or combustion chamber onto the coals of the previous log, and the new green log occupies the former front or cooking position.

My stove also optionally eliminates the requirement of stack blowers to reclaim heat in that my stove provides for an adjustable top refractory plate and an upper plenum chamber above the combustion chamber, wherein there is an optional serpentine or baffle arrangement to provide for a tortuous flow path for the gaseous combustion gases discharged from the combustion chamber. This construction permits maximum extraction of heat from the hot combustion gases before being discharged from the flue of the stove. My adjustable top refractory material in addition permits easy adjustment, so that a desired amount of the serpentine or tortuous gaseous flow path may be utilized if desired, or the baffle elements may be avoided and the gaseous products may be discharged directly to the flue.

My stove, being a full refractory design and containing a metal shell enclosing the refractory firebox, provides a heat-sink design which, once heated, requires very little heat to maintain the desired temperature, with the stove radiating such heat slowly and evenly about a large radiation area. My stove, by employing a very large radiation area, together with its large mass heat sink, provides for a slow, even heat release once the high combustion temperature has been reached.

My stove also includes a unique draft-control means and feature which permits the employment of a long thin flow of air across almost the entire length of the firebox or combustion chamber of the stove, and provides for a better and rapid control of the draft than in prior-art stoves.

Also, my stove comprises means for the rapid and easy sealing adjustment of the bottom portion of the door against the bottom wall of the entrance to the combustion chamber. Although my stove will be described in one preferred embodiment as directed to the combustion of large and particularly green logs, it will be recognized by those persons skilled in the art that my stove may be employed for other purposes, and various modifications and changes may be made in the preferred embodiment of my stove and its operation, without departing from the spirit and scope of my invention.

DESCRIPTION OF THE EMBODIMENTS

Figure 1:
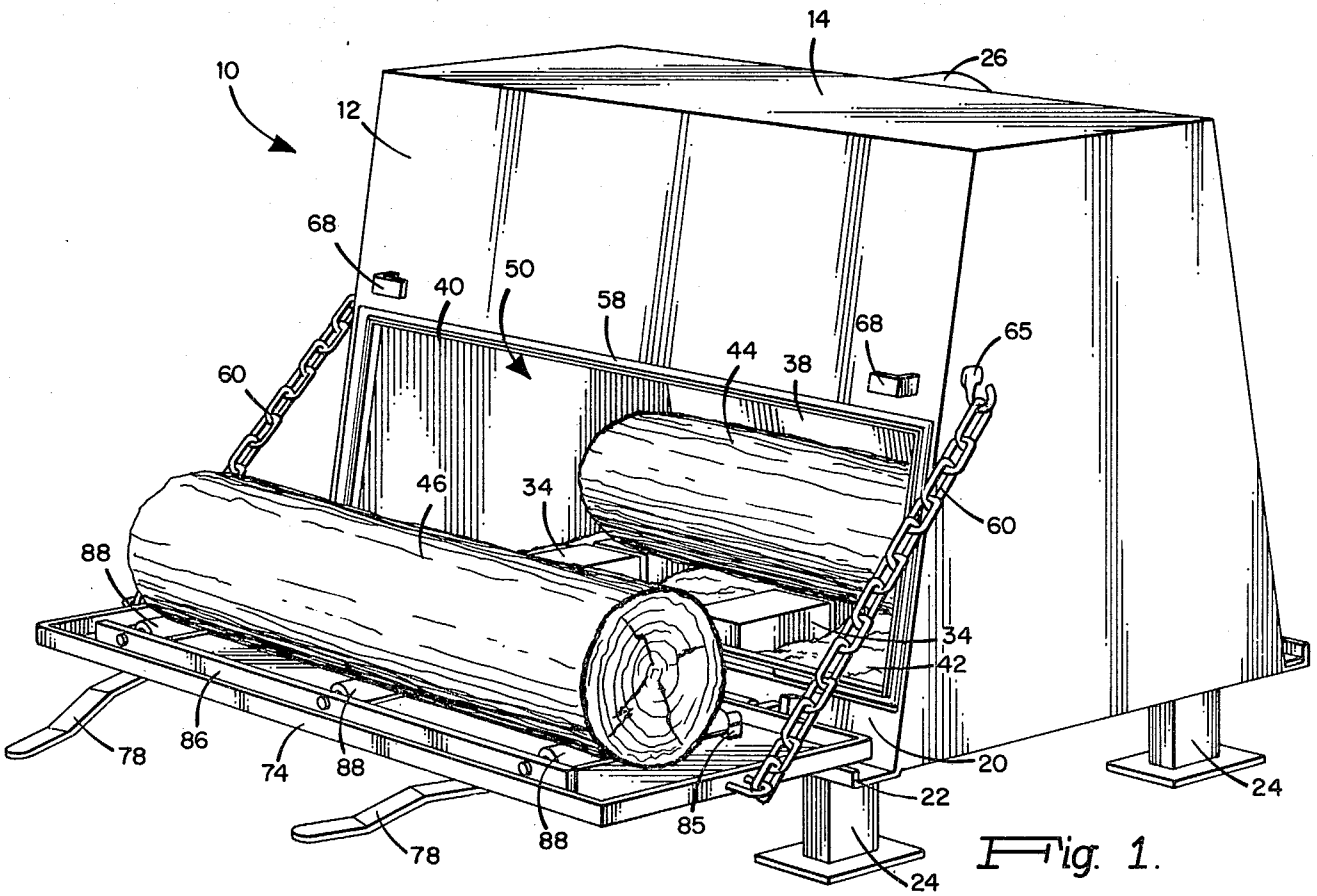
FIG. 1 is a perspective view of my stove with the loading door open.

My log-burning stove 10, which has a generally rectangular front and back trapezoidal end design, comprises a steel outer shell with a front upper wall 12, a top 14, a back wall 16, a bottom 18, a front lower wall 20 and supporting legs 24. A service lip or gutter 22 is welded to the front lower wall 20 directly beneath a rectangular door opening or entrance into the combustion chamber of the stove. A flue connector 26 is provided in the upper portion of the back wall 16 for the discharge of gaseous combustion products. The bottom 18 of the stove has a layer of particulate refractory material 42, such as sand, sloping from the back wall 16 toward the front lower wall 20 within the firebox or combustion chamber 50 defined by the outer shell. Within the firebox or combustion chamber are disposed three rows of fire bricks 34 retained in position by angle irons 32 on either side to support logs within the combustion chamber, with the upper surface of the fire bricks extending above the sand 42 level.

My stove contains a full refractory firebox wherein there is disposed rear refractory plate 38 typically composed of two plates which overlap in the center, with the plates of a size to permit the insertion of the plates through the entrance 50, and trapezoidal-type end refractory plates 40 and 41, the end plates each held in position by a plate clamp 62, the plate clamp held by screw 64.

The refractory plate material is assembled rapidly and easily within the stove. One end of the refractory plate 40 is placed in an upright position and is locked in place with clamp 62. Thereafter, one of the two rear refractory plates 38 is introduced through the entrance and is slid into position, with the one edge leaning against the back edge of the side plate 40. Then an adjustable refractory top plate 36 is placed into position, so that it rests on the top edge at one end of the side plate 40, and its back edge on the top edge of the first half of the rear plate 38. Thereafter, the second rear refractory plate 38 is introduced and is raised into its position, with one edge adjacent and preferably overlapping the other rear refractory plate edge to form plate 38. Thereafter, the end refractory plate 41 is raised in position and is locked into place with a second plate clamp 62 at the other end of the stove. The upper edge of the plate 41 then provides direct support for the other end of the adjustable top refractory plate 36. After such assembly, the firebox is lined on the sides and top with refractory plate material with sand on the bottom, with only two clamps required. In such assembly, the top refractory plate 36 is resting at each end on the top edge of each of the end plates 40 and 41. The top adjustable plate 36 has a width less than the width of the top edge of the side plates 40 and 41, and can be slid or moved forward or backward as desired. The top plate 36 provides the upper portion of my stove into an upper plenum chamber, which chamber contains a series of straight baffles 30 and a V-type baffle 28, whereby gaseous combustible products, passing upwardly from the lower combustion chamber, pass through the elongated open-slot area disposed by the top refractory plate, and pass into the upper chamber and optionally through the baffles 28 and 30 prior to being discharged from the flue 26.

Figure 2:
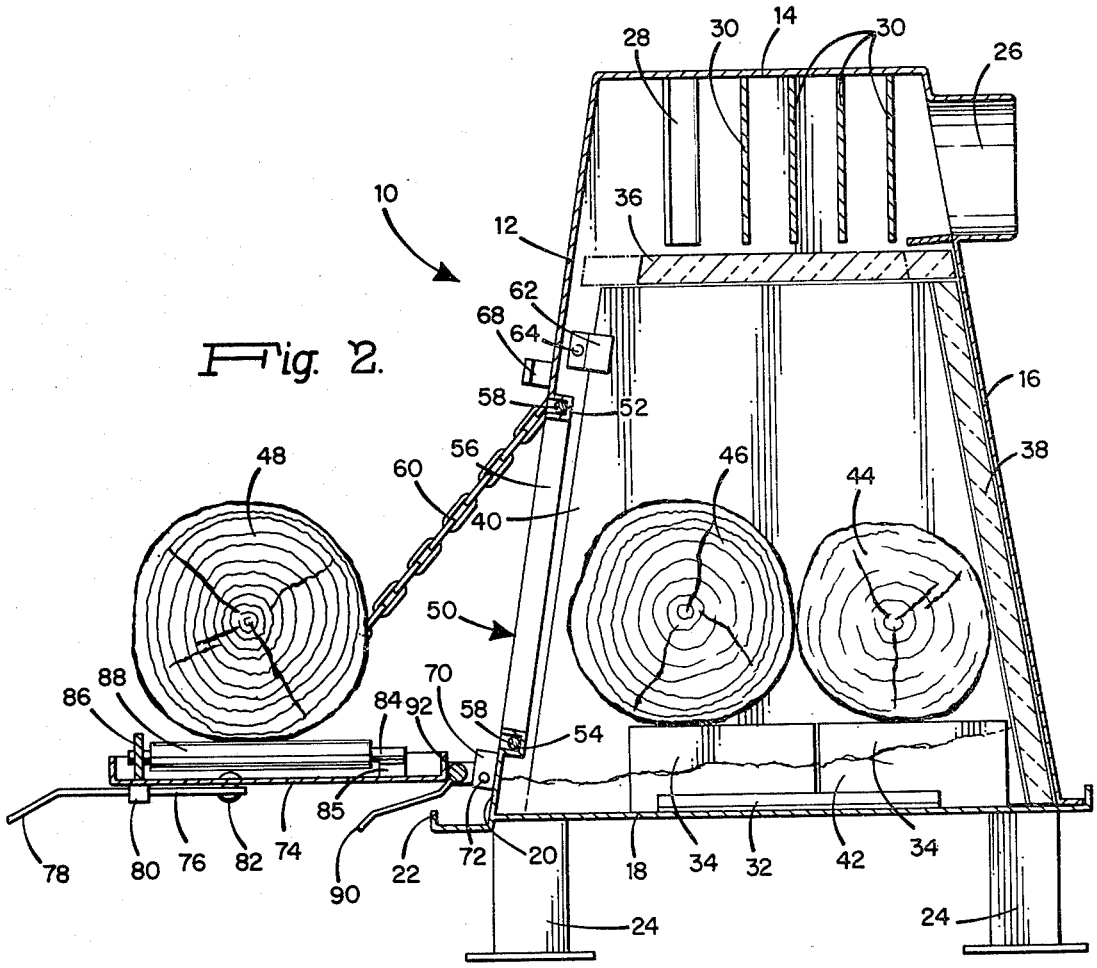
FIG. 2 is a cross-sectional view of my stove taken along the lines 2—2 of FIG. 3.

My design, therefore, permits a full refractory lining in my stove which is assembled easily, so that it can be interlocked and maintained in place by only two end clips, one at each end of the side refractory plates 40 and 41, and also permits an adjustable top refractory plate which, by movement forward or backward, passes whatever portion of the draft and gaseous combustion products desired through whatever portion of the baffles in the above chamber as desired. In FIG. 2, the top refractory plate 36 is shown as moved backward against the rear refractory plate 38, so that all of the draft passes through the entire baffles 28 and 30 system in the upper chamber before being discharged through the flue 26, with the top refractory plate 36 shown in dotted lines in its forward position where the gases pass directly onto the back of the stove to the flue connector. My baffles are utilized to extract heat by passage through the upper plenum chamber, or, where this is not desired, due to the low temperature of the combustion products, or if it is desired to avoid the deposition of combustion products in the upper chamber, the adjustable refractory plate 36 may be moved forward for direct discharge of the products through the flue connector 26.

Figure 3:
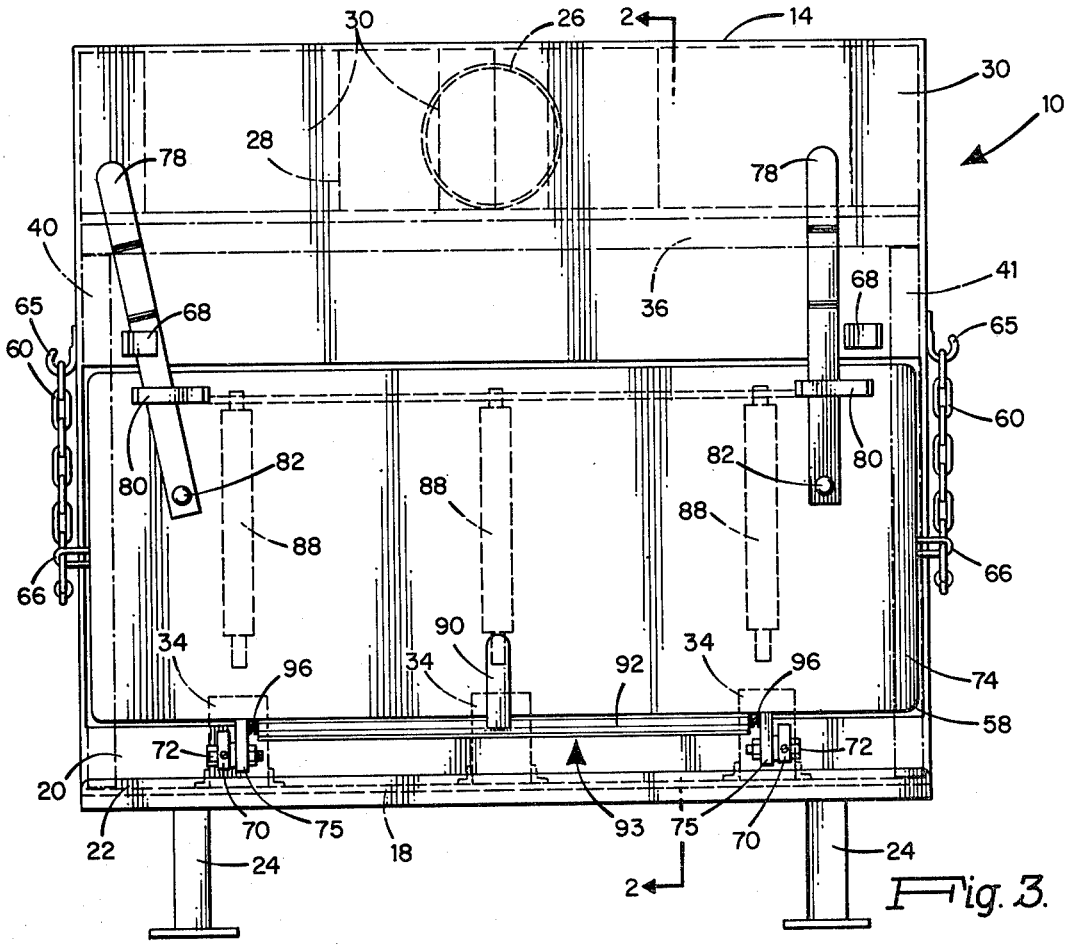
FIG. 3 is a front elevational view of my stove with portions of the loading means exposed.

For the purposes of illustration only, my stove is shown with a log 44 in the burning position against and adjacent the rear refractory plate 38 wall, with a second green log 46 in the forward cooking position and, for the purposes of illustration, with a log 48 placed on the open loading door ready to be moved into the firebox. Of course, during combustion, logs 44 and 46, both or only one, would remain in the firebox and the door would be closed. My stove includes a door opening 50 which extends the full length of the rectangular front wall to permit the insertion of the large economical-size logs. The opening is sealed by a door 74 which closes by upward movement against peripheral channels around the opening 50 which comprises a top seal channel 52, a bottom seal channel 54 and side seal channels 56, which channels contain a heat-sealing gasket 58 therein, such as a compressible asbestos gasket. As illustrated, the sealing gasket 58 only extends inwardly at each end of channel 54. In the open log-supporting and loading position, the door 74 is retained in an outwardly extended, generally lateral, horizontal position from the opening 50 by a pair of support chains 60 at each end thereof, one end of the chains secured to a door clamp 66 and the other end of the chain to a clamp 65. Above the entrance 50 and on either end of the front upper wall 12 are positioned open-angled door clamps 68, each designed to receive and retain the upper ends 78 of door handles 76. The ends 78 of the handles 76 are designed to fit within the door clamps 68, the door handles 76 pivoted at their lower ends through pivotable screws 82, and having lower support guides 80 on the door 74. The door handles 76 extend outwardly from the door 74 in the open loading position, so as to permit the user to employ the handles to provide leverage to the upward movement of the doors to move the heavy log on the door through the opening 50 and into the firebox. As illustrated in FIG. 3, the right-hand door handle 76 is shown in an upright unlocked position, while the left-hand door handle 76 is shown at an angled locked position within the door clamp 68.

The door 74 is positioned for movement between a closed and an open or loading position by hinge means which comprises a pair of hinge members 70 secured to the front lower wall 20 of the stove, the door secured to the hinge member 70 through hinge pins 72 and nut 73 and hinge member 75. The pin 72 is in an elongated slot 98, with a threaded set screw 99 to permit adjusting and positioning of the pin 72 in the slot 98.

The door 74 in the open or log-loading position includes a plurality of rollers 88 free-wheeling about fixed axles 84, one end of each axle being supported in an elongated roller support plate or rib 86, and the other end in individual support blocks 85 on the internal surface of the door. The roller surface is disposed above the surface of the rib 86 and supports 85. The rollers 88 are disposed generally parallel to each other and in the plane of the door 74 in the open position, with the door extending in a supported position generally laterally and horizontally outward from the entrance, and generally perpendicular from the plane of the opening 50. Any number of rollers may be employed, but typically the rollers should be spaced and be sufficiant to provide for support of the logs to be used, and generally would comprise two or three rollers. The rollers are aligned to provide for lateral movement of the log placed therein generally parallel to the opening 50.

In operation, the log to be used is moved, for example, to one or the other sides of the door in the open position. The log is tilted onto the door and is pushed generally laterally onto the rollers 88, which permit easy lateral movement of the heavy log to a central position adjacent the opening 50. Thereafter, the log, once centered, may be moved easily into the firebox by the user's grasping the handle ends 78 and moving them upwardly to move the door 74 toward its upward closed position. The leverage afforded by elongated handles 76 permits the easy forward movement of the log into the firebox and onto the cooking position on the rows of fire bricks 34. Of course, if desired, the log merely may be rolled from its central position into the chamber without the use of the door leverage.

Figure 5:
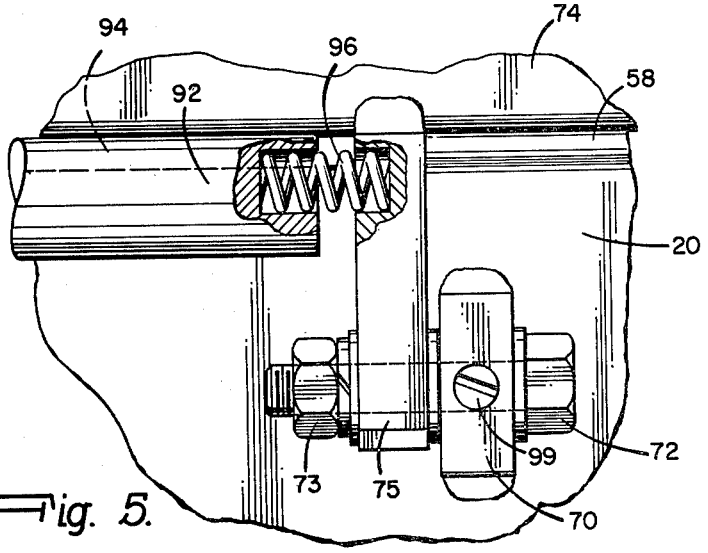
FIG. 5 is an enlarged partially cross-sectional fragmentary elevational front view of the draft-control and door-adjustment mechanisms of my stove.
Figure 4:
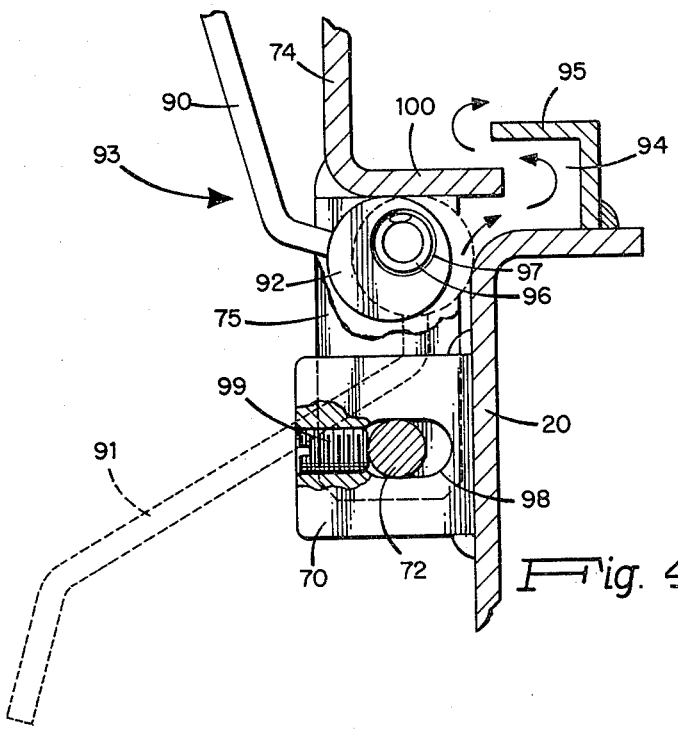
FIG. 4 is an enlarged partially cross-sectional fragmentary end view of the draft-control and door-adjustment mechanisms of my stove.

My stove includes a draft-control mechanism 93, shown more particularly in FIGS. 4 and 5, which comprises a draft-control handle 90 in the open position, and shown in dotted lines 91 in the closed position, and which is welded to an elongated, eccentrically mounted draft shaft or rod 92. The eccentric pivot points of the shaft 92 are a pair of stiff coiled springs 96 disposed in shaft opening 97 at each end, which springs 96 are disposed in hinge members 75, the springs 96 providing friction to adjust and to hold the draft rod 92 in place, and also to flex sideways or laterally to insure positive sealing contact with the lower flange bottom 100 of the door 74 and the lower portion 20 of the stove, when the draft rod is in the closed 91 position. This spring mechanism permits adjustment and positive closing of the draft, regardless of the dimensional error or adjustment of the door 74 sealing against the gasket 58 at each end. The springs 96 provide for dimensional differences which may often occur because of uneven heat expansion of the draft shaft 92 and the door 74. Typically, the shaft 92 and springs 96 remain cool, because of the cold airflow, while the door 74 tends to become quite hot up to 500° F. My draft system 93 provides for an elongated air-draft slot 98 which extends across a substantial length of the bottom portion of the door. The draft-control means permits a thin flow of air across almost the entire length of the firebox of the stove, as opposed to conventional drafts which oftem employ merely round draft holes. My full-length draft-control mechanism, on the eccentric pivotable movement of the shaft 92 by the handle, can control the opening of the draft slot 98, and, therefore, the air path 94, as defined by the bottom flange of the door and the angle 95 extension of the channel bottom 54. The mechanism provides a rapid and precise adjustment by about a 120-degree motion of the draft-control handle positions 90 and 91. In operation, the adjustable eccentric movement of the shaft 92, by the door handles between the closed position 91 and the open position 90, permits a flow of thin draft air across the lower edge of the door 74 into the firebox.

FIGS. 4 and 5 also show an additional detail of my door-adjusting mechanism, wherein hinge members 70 are welded to the front lower wall 20 of the stove, and have a slotted hole 98 for the insertion of the hinge pin 72, with a threaded set screw 99 bearing on the hinge pin 72. The bottom of the door 74 can be adjusted easily and rapidly by turning the set screw 99 inwardly against pin 72 in slot 98, which forces the lower portion or wall of door 74 at each end against the compressible asbestos door-sealing gasket 58.

My stove, therefore, as described and illustrated, provides for, in combination, a unique log-loading method, whereby large- and economical-size logs may be introduced easily into the firebox. A full refractory design for the firebox, with an adjustable top refractory plate, permits, in combination with a tortuous gaseous flow path, the saving of heat. A door-adjusting mechanism permits rapid and simple adjustment of the door in a sealing relationship against the lower gasket. A unique draft-control mechanism and system provides for a full-length draft flow across the substantial length of the firebox, and provides for quick and precise adjustment of such air-draft flow. My stove permits the combustion of large green logs in a unique burning system, and provides other advantages, as well as simplicity of operation and construction not heretofore provided by prior-art stoves.

What I claim is:

1. A stove which comprises in combination:

(a) a shell surrounding a combustion chamber;

(b) a flue for the discharge of gaseous combustion products from the combustion chamber;

(c) an entrance door in the shell extending substantially across the width of the stove, the door adapted to be placed between an open and a closed position;

(d) a plurality of refractory plate elements within the shell, which elements define a combustion chamber, the plate elements of a size to permit the insertion of the plate elements through the entrance door and including at least a single back, top, and two opposing side plate elements, the back and side elements in contacting relationship to form a peripheral refractory wall of the combustion chamber;

(e) the top refractory plate element having a width less than that of the top of the side plate elements and positioned at each end on the upper top edge of said side plate elements to define an upper plenum chamber and a lower combustion chamber, with an elongated flow passageway extending substantially the length of the combustion chamber for the passage of gaseous combustion products from the lower combustion chamber through the flow passageway to the upper plenum chamber into the flue, the top refractory plate element resting at each end on the top edge of the said side plate elements, and wherein said top refractory plate element is adjustable to permit the said flow passageway to be positioned between the front and the back of the combustion chamber;

(f) plate clamp means to retain each of the side plates in position within the shell; and (g) draft control means to permit and control the entrance of air into the combustion chamber.

2. The stove of claim 1 wherein the elongated flow passageway formed by the said top refractory plate element extends along the front of the combustion chamber and directly above the door entrance thereof.

3. The stove of claim 1 wherein said side plates and said back plate have their respective edges thereof in an overlapping contacting relationship.

4. The stove of claim 1 wherein the said two side plates are trapezoidal in shape with the short parallel side of the plate forming the upper edges thereof, each of said side plates maintained in position by means of a single edge clamp and wherein the back plate comprises a plate which rests on the rear sloping edge of each of said side plates.

5. The stove of claim 4 wherein the back plate comprises two back refractory plate elements wherein at least one edge of each of the elements is disposed in a overlapping interlocking relationship.

6. The stove of claim 1 wherein the entrance door in a closed upright position seals the door entrance and in an open position extends generally laterally outwardly adjacent to and from the lower bottom edge of the door entrance.

7. The stove of claim 1 wherein the clamp means includes a plate edge clamp secured to the metal shell and which plate edge clamp retains one edge of the side plates in an upright supporting position.

8. The stove of claim 1 wherein the draft control means comprises:

(a) an elongated opening beneath the door entrance to permit the passage of air into the combustion chamber;

(b) an eccentrically rotatable rod member extending generally adjacent and parallel to the draft opening;

(c) means to secure the rod member for eccentric rotation; and (d) handle means to move the rod member between a closed position wherein the rod seals the elongated opening and an open position wherein the elongated member is moved away from the opening to admit draft air.

9. The stove of claim 1 which includes baffle means in the upper plenum chamber to provide for the tortuous flow passage of gaseous combustion products through the plenum chamber to the flue.

10. The stove of claim 1 which includes particulate refractory matter disposed in a layer covering the bottom of the shell and means to support a log or other combustible material above such particulate refractory layer.

11. A method of manufacturing a refractory-lined stove which comprises a shell defined by a generally rectangular back and front portions and trapezoidal sides, an entrance door in the front of the shell, a refractory lining composed of a plurality of refractory plate elements which form a combustion chamber within the shell, a flue for the discharge of gaseous products from the combustion chamber, and a draft control means to admit and control air flow into the combustion chamber the method of forming the refractory lining in the stove which method comprises:

(a) introducing the first side refractory plate element through the door entrance and into an upright position on one side of the shell;

(b) securing the first upright side refractory plate element position;

(c) introducing one of two rear refractory plate elements through the door entrance and into a rear position with one edge of the said back plate element leaning against the back edge of the first upright side plate element;

(d) introducing a refractory top plate element through the door entrance and positioning said top plate element so that it rests on the top edge of one end of the upright side plate element with its back edge on the top edge of the said rear refractory plate element;

(e) introducing through the door entrance a second back refractory plate element with one edge adjacent to the edge of the first back refractory plate element and forming a back refractory lining;

(f) introducing a second side refractory plate element through the door entrance and positioning said second refractory plate element at the opposite end from first refractory plate element;

(g) securing the second side refractory plate element in an upright position so that the upper edge of the said second side refractory plate element provides direct support for the other end of the top refractory plate element;

(h) the top refractory plate element having a width less than the width of the top of the said first and second side refractory plate elements and forming an elongated passageway across the width of the combustion chamber dividing the interior of the shell into an upper plenum chamber and a lower combustion chamber so that gaseous products may pass in the combustion chamber through the elongated opening into the plenum chamber and out the flue; and (i) the refractory plate so assembled that the top refractory plate is resting at each end on the top edge of each of said side refractory plates and the back refractory plates at one edge are resting against the adjacent edge of the side refractory plate thereby providing for a fully refractory-lined stove.

12. The method of claim 11 which includes disposing particulate refractory material on the bottom surface of the shell.

13. The method of claim 11 which includes adjusting the position of the top refractory plate element so as to move the elongated flow passage between a front and rear position to control the length of the flow of the gaseous products from the combustion chamber.

14. The method of claim 11 which includes introducing air through a draft control elongated opening which extends just below a door entrance and which extends substantially the width of the combustion chamber.

15. The method of claim 11 which includes securing the side plate elements in position employing a single edge clamp for each side plate.

16. A stove which comprises in combination:

(a) a shell surrounding a combustion chamber;

(b) a flue for the discharge of gaseous combustion products from the combustion chamber;

(c) an entrance door in the shell extending substantially across the width of the stove, the door adapted to be placed between an open and a closed position;

(d) a plurality of refractory plate elements within the shell, which elements define a combustion chamber, the plate elements of a size to permit the insertion of the plate elements through the entrance door and including at least a single back, top and two opposing side plate elements, the back and side elements in contacting relationship to form a peripheral refractory wall of the combustion chamber, the two side plate elements being trapezoidal in shape, with the short parallel side of each side plate element forming the upper edges thereof, each of the side plate elements maintained in position solely by a single edge clamp means, and wherein the back plate element comprises two back plate elements, one edge of each back plate element resting on the rear sloping edge of one of the side plate elements;

(e) the top refractory plate element having a width less than that of the top of the side plate elements and positioned at each end on the upper top edge of said side plate elements to define an upper plenum chamber and a lower combustion chamber, with an elongated flow passageway extending substantially the length of the combustion chamber for the passage of gaseous combustion products from the lower combustion chamber through the flow passageway to the upper plenum chamber into the flue;

(f) plate clamp means to retain each of the side plates in position within the shell; and (g) draft control means to permit and control the entrance of air into the combustion chamber.

17. The stove of claim 1 wherein the entrance door in a closed upright position seals the door entrance and in an open position extends generally laterally outwardly adjacent to and from the lower bottom edge of the door entrance.

18. The stove of claim 1 which includes baffle means in the upper plenum chamber to provide for the tortuous flow passage of gaseous combustion products through the plenum chamber to the flue.

* * * * *

UNITED STATES PATENT OFFICE

CERTIFICATE OF CORRECTION

PATENT NO. : 4,236,500

DATED : December 2, 1980

INVENTOR(S) : J. Robert Choate

It is certified that error appears in the above-identified patent and that said Letters Patent are hereby corrected as shown below:

In claims 17 and 18, lines 18 and 23 respectively, delete "claim 1" and insert therefor --claim 16--.

Signed and Sealed this

*Third* Day of *March 1981*

[SEAL]

*Attest:*

RENE D. TEGTMEYER

*Attesting Officer*

*Acting Commissioner of Patents and Trademarks*